US010825364B2

(12) United States Patent
Garcia

(10) Patent No.: US 10,825,364 B2
(45) Date of Patent: Nov. 3, 2020

(54) LIQUID LIGHT WALL

(71) Applicant: Portable Walls Holding LLC, Houston, TX (US)

(72) Inventor: Justin Emory Garcia, Houston, TX (US)

(73) Assignee: PORTABLE WALLS HOLDING, LLC, Houston, TX (US)

( * ) Notice: Subject to any disclaimer, the term of this patent is extended or adjusted under 35 U.S.C. 154(b) by 0 days.

(21) Appl. No.: 16/796,424

(22) Filed: Feb. 20, 2020

(65) Prior Publication Data

US 2020/0265759 A1 Aug. 20, 2020

Related U.S. Application Data

(60) Provisional application No. 62/808,062, filed on Feb. 20, 2019.

(51) Int. Cl.

| | |
|---|---|
| ***G09F 13/24*** | (2006.01) |
| ***F21S 10/00*** | (2006.01) |
| ***F21V 9/12*** | (2006.01) |
| *F21W 121/02* | (2006.01) |

(52) U.S. Cl.

CPC ..... *G09F 13/24* (2013.01); *F21S 10/002* (2013.01); *F21V 9/12* (2013.01); *F21W 2121/02* (2013.01)

(58) Field of Classification Search

CPC ..... G09F 13/24; F21S 10/002; F21V 9/12; F21W 2121/02

See application file for complete search history.

(56) References Cited

U.S. PATENT DOCUMENTS

| | | | | |
|---|---|---|---|---|
| 3,530,615 A * | 9/1970 | Meyer | A63F 9/06 446/91 |
| 4,196,539 A * | 4/1980 | Speers | A63F 11/00 40/547 |
| 6,729,932 B2 * | 5/2004 | Jarvis | A63H 33/22 362/456 |

* cited by examiner

*Primary Examiner* — Evan P Dzierzynski
*Assistant Examiner* — Keith G. Delahoussaye
(74) *Attorney, Agent, or Firm* — Bracewell LLP; Brad Y. Chin

(57) ABSTRACT

Embodiments provide an illuminated design in a liquid light wall. According to an embodiment, there is provided a liquid light wall including a front wall with a plurality of circular openings through which transparent pipettes may be inserted. The pipettes are filled with a colored liquid. The colored liquid can be edible. A light source shines light from behind the front wall, transferring the light through the pipettes, showcasing a design. The pipettes can be readily removed from the circular openings. Embodiments provide for a modular design of the liquid light wall such that multiple modules can be attached to one another.

18 Claims, 9 Drawing Sheets

LIQUID LIGHT WALL

CROSS REFERENCE TO RELATED APPLICATIONS

This application claims the benefit of and priority to U.S. Provisional Patent Application 62/808,062, filed on Feb. 20, 2019, entitled, "LIQUID LIGHT WALL," which is hereby incorporated by reference in its entirety into this application.

BACKGROUND

Embodiments relate to an interactive light apparatus. More specifically, embodiments relate to a lit apparatus containing removable containers, each container including a plurality of pipettes filled with edible liquid configured to form an artistic design.

DESCRIPTION OF RELATED ART

Whether for weddings, birthdays, holidays, grand openings, or get-togethers, celebrations are pivotal to the human experience. Celebrations, artistic events, marketing promotions, open houses, and other events are also important for the community and the economy. Often, rented or purchased articles are used to enhance the celebrations, provide an opportunity for fundraising, act as a marketing face, provide entertainment, or simply spark conversation between guests. Companies and individuals often use these rented or purchased articles, in addition to decorations, food, drink, and activities, to enhance the celebration or event.

Entertainment, decoration, and food are all important elements of an event. An ideal article used at an event or celebration would fulfill the needs of multiple requirements—it would serve as a source of entertainment and discussion, function as a piece of decoration, add marketing value if needed, and even serve as food or beverage. Additionally, it would be interactive, inspiring discussion and activity between the article and the guests around it. The article would ideally be portable, versatile, and sturdy to be taken to events time and again. Additionally, the article would change from event to event, ensuring that no two events had the exact same environment. If the event is being hosted by a company, the marketing value should also be considered.

Events can feature elaborate cakes, interactive games, custom cocktail creations, fine art displays, and even inflatable bouncy castles, all to impress guests and encourage interaction. However, all of the options are missing an important element. For example, cakes are generally not interactive, and food or drink do not mix with inflatable bouncy castles. Many different options are available, but few options can combine all of these aspects together in an appealing fashion.

SUMMARY

The various embodiments disclosed herein provide an interactive, decorative, artistic, functional, portable, versatile, and unique apparatus for a liquid light wall. The embodiments disclosed herein provide for a light source disposed inside of a box-like structure, whereby a number of circular openings have been created in the front wall of the structure. The box-like structure can be comprised of an opaque material. A pipette can be inserted into each circular opening, each pipette having a pipette bulb and a pipette stem. The pipette bulb has a diameter greater than the diameter of the circular opening; therefore, when the pipette stem is inserted into the circular opening in the front wall of the structure, the pipette bulb is disposed outside the front wall and the pipette stem is disposed inside the structure. The pipette can be filled with liquids. The liquids can be edible. The pipette can be comprised of a transparent material. The liquid can be transparent, semi-transparent, or opaque. The light from the light source illuminates the pipette and the liquid inside the pipette, and can be seen through the pipette bulb.

An object of the various embodiments is to provide a decorative, illuminated piece of interactive art for an event. The illuminated light wall can even provide marketing value to a company. According to at least one embodiment, an object is to provide liquid for edible consumption in a pleasurable and interactive way. Another object of the various embodiments is to be portable and versatile. According to various embodiments, the object of portability and versatility can be achieved through a modular design.

According to at least one embodiment, there is provided an apparatus for generating illuminated designs in a liquid light wall, the apparatus including a front wall, the front wall including a plurality of circular openings. The circular openings traverse through from an outside face of the front wall to an inside face of the front wall, and the circular openings have a circular opening diameter. The apparatus further includes a back wall, opposed to the front wall; side walls, perpendicularly abutting the front wall and back wall, such that the front wall, the back wall, and the side walls form a box-like structure; and a light source, placed inside of the box-like structure. The apparatus further includes a plurality of pipettes, each pipette including a pipette bulb and a pipette stem, where the pipette bulb has a diameter wider than a diameter of the pipette stem, and the pipette is made of a pipette material which allows light to pass through the pipette material. According to an embodiment, the pipette is inserted into one of the plurality of circular openings such that the pipette stem of each of the plurality of pipettes extends inside the box-like structure and the pipette bulb extends outside the box-like structure. According to an embodiment, the diameter of the pipette bulb is wider than the circular opening diameter such that when each pipette is inserted into one of the plurality of circular openings, the pipette cannot be inserted fully into the box-like structure. According to an embodiment, the light source generates light which is transferred through each of the plurality of pipettes.

According to at least one embodiment, at least one of the plurality of pipettes is filled with a liquid. According to at least one embodiment, the liquid is edible.

According to at least one embodiment, the pipette stem includes a pipette opening. According to at least one embodiment, the pipette steam is hermetically sealed.

According to at least one embodiment, the apparatus further includes a power source, arranged inside the box-like structure, and the power source provides power to the light source.

According to at least one embodiment, the apparatus further includes a top wall, arranged to abut the front wall, the back wall, and the side walls; and a bottom wall, arranged to abut the front wall, the back wall, and the side walls, such that the top wall and the bottom wall together with the front wall, the back wall, and the side walls form the box-like structure which is enclosed.

According to at least one embodiment, the plurality of circular openings are evenly dispersed across the front wall in a grid-like pattern.

According to at least one embodiment, an apparatus is provided for a liquid light wall module, and the apparatus includes an illuminated module, where the illuminated module includes a front wall, a first side wall, a second side wall, a top wall, a bottom wall, and a back wall; the front wall includes a plurality of circular openings dispersed across the front wall, where the circular openings perforate the front wall; a plurality of pipettes, each pipette having a pipette bulb and a pipette stem, where the pipettes are made of a transparent material; and a light source, the light source positioned such that light can escape through the plurality of circular openings in the front wall. According to at least one embodiment, the illuminated module is assembled such that the front wall is affixed perpendicular to the first side wall, the second side wall, the bottom wall, and the top wall, and further where the illuminated module is assembled such that the first side wall and the second side wall are parallel to one another, and the top wall and the bottom wall are parallel to one another, such that the illuminated module forms a box-like structure, so that the back wall is positioned parallel to the front wall, and further so that the back wall is affixed perpendicular to the top wall, the bottom wall, the first side wall, and the second side wall. According to at least one embodiment, the pipette bulb has a diameter larger than a diameter of the circular opening, such that when the pipette stem is inserted into one of the plurality of circular openings, the pipette bulb blocks the circular opening, such that light passes through the pipettes.

According to at least one embodiment, at least one of the plurality of pipettes is filled with a liquid. According to at least one embodiment, the liquid is edible.

According to at least one embodiment, the apparatus includes a non-illuminated module, and the non-illuminated module includes a solid wall, a first side wall, a second side wall, a top wall, a bottom wall, and a back wall; and the non-illuminated module is assembled such that the solid wall is affixed perpendicular to the first side wall, the second side wall, the bottom wall, and the top wall, and further where the non-illuminated module is assembled such that the first side wall and the second side wall are parallel to one another, and the top wall and the bottom wall are parallel to one another, such that the non-illuminated module forms a box-like structure; and the back wall is positioned parallel to the solid wall, the back wall affixed perpendicular to the top wall, the bottom wall, the first side wall, and the second side wall, such that the non-illuminated module is enclosed.

According to at least one embodiment, the apparatus for the liquid light wall module includes the first side wall, the second side wall, the top wall, and the bottom wall, which includes a plurality of access openings, such that an interlocking mechanism installed between the access openings can affix a first illuminated module to a second illuminated module when the access openings of the first side wall of the first illuminated module aligns to the access openings of the second side wall of the second illuminated module.

According to at least one embodiment, the apparatus includes a back wall, which further includes a fixed backing, where the fixed backing is affixed perpendicular to the top wall, the bottom wall, the first side wall, and the second side wall, such that the illuminated module is enclosed; a detachable cover, where the detachable cover abuts the fixed backing such that the fixed backing and the detachable cover are contiguous; a backing support, where the backing support is affixed perpendicular to the side walls and abuts the fixed backing; and a cover attachment mechanism, where the cover attachment mechanism is affixed to the backing support, and temporarily affixes the detachable cover to the backing support, such that the detachable cover is removable, and further such that the detachable cover is approximately flush with the fixed backing.

According to an embodiment, the back wall further includes a mounting hole, such that the illuminated module can be affixed to a stable surface. According to an embodiment, the apparatus further includes a power source, the power source configured to provide power to the light source.

According to an embodiment, the apparatus further includes a base assembly, and the base assembly further includes a base attachment mechanism, where the base assembly is configured to stabilize the non-illuminated module in a vertical position, and further where the base attachment mechanism is configured to affix the base assembly to the non-illuminated module.

According to an embodiment, the apparatus further includes a base assembly, and the base assembly further includes a base attachment mechanism, where the base assembly is configured to stabilize the illuminated module in a vertical position, and further where the base attachment mechanism is configured to affix the base assembly to the illuminated module.

An apparatus including the liquid light wall according to various embodiments.

DETAILED DESCRIPTION

Modes for carrying out the various embodiments will now be described, but the invention is not intended to be limited to the following embodiments. It should be understood that those in which changes, improvements, or the like are appropriately added to the following embodiments based on ordinary knowledge of a person skilled in the art are also included in the scope of the various embodiments without departing from the spirit of the invention.

Here, the term "opaque" is used as a term indicating that light does not readily penetrate the material. The term "translucent" is used as a term indicating that some to all light is able to penetrate and pass through the material. The term "translucent" is intended to encompass the term "transparent." The term "outside face" is not intended to be bound by this definition, but generally means a face of an article to which a user faces and can generally see. The term "inside face" is not intended to be bound by this definition, but generally means a face of an article to which the user may not see when the user faces the article.

Here, the term "height" is used as a term indicating a measurement in the vertical direction. The term "width" refers to a measurement in the horizontal direction.

The liquid light wall according to at least one embodiment includes a box-like structure in which a light source is provided. In an embodiment, the plurality of circular openings have been created in the front wall of the structure. Preferably, a pipette is inserted into each circular opening, each pipette having a pipette bulb and a pipette stem. In an embodiment, the pipette bulb has a diameter greater than the diameter of the circular opening; therefore, when the pipette stem is inserted into the circular opening in the front wall of the structure, the pipette bulb is disposed outside the front wall and the pipette stem is disposed inside the structure. Preferably, the pipette can be filled with liquids, including, for example, edible liquids. Preferably, the pipette is made from a transparent material. In an embodiment, the liquid can be transparent, semi-transparent, or opaque. Preferably, the light from the light source illuminates the pipette and the liquid inside the pipette, and the light can be seen through the pipette bulb.

The light wall according to at least one embodiment is a liquid light wall comprised of (A) the front wall, (B) the plurality of the pipettes, (C) the light source, (D) the side walls, and (E) the back wall. In at least one embodiment, the liquid light wall is further comprised of (F) the top wall and (G) the bottom wall. In at least one embodiment, the liquid light wall is in a module form, further comprised of (H) the illuminated module, (I) the non-illuminated module, and (J) the base assembly.

(A) Front Wall

Figure 1:
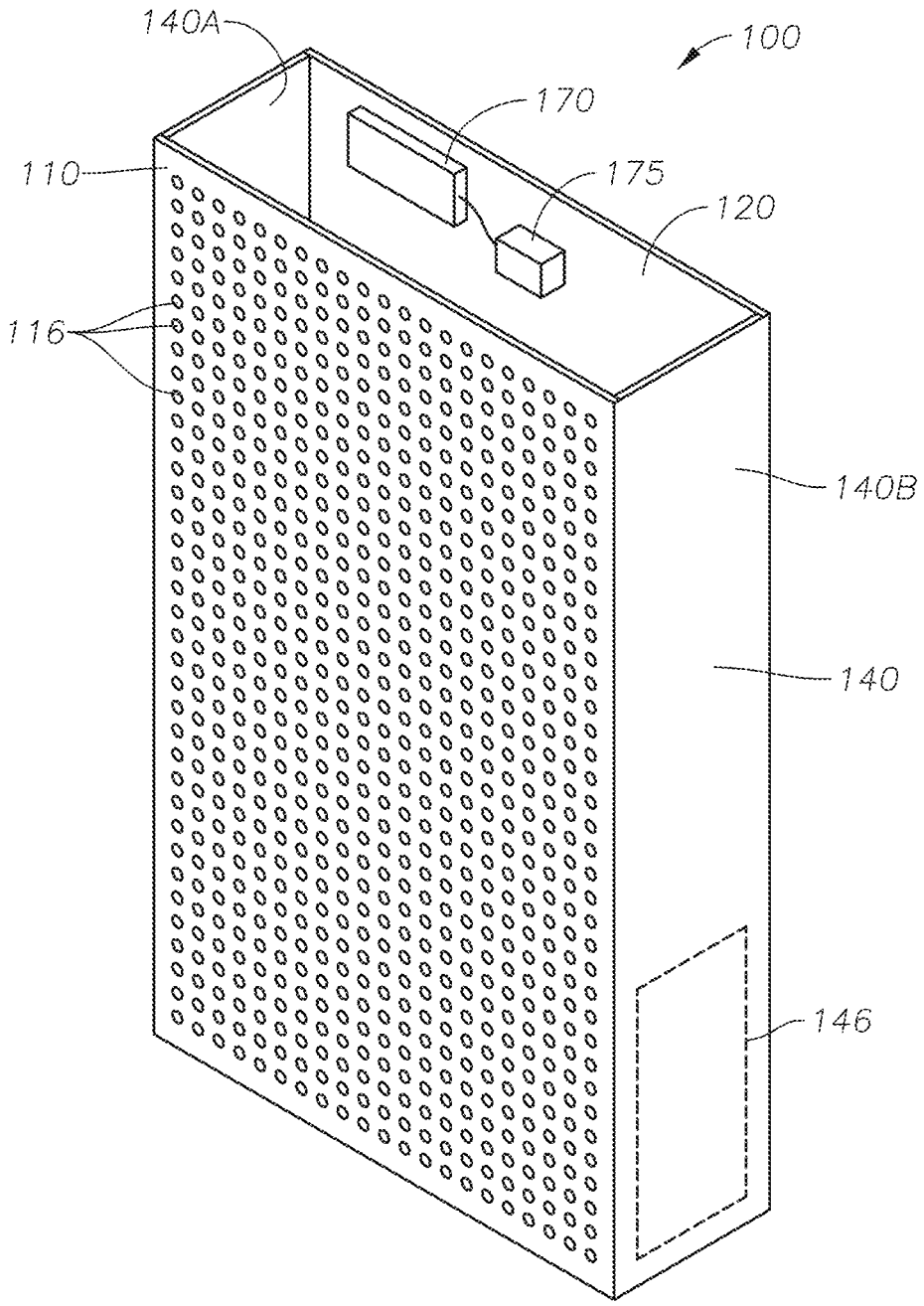
FIG. 1 is a representation of a liquid light wall according to an embodiment.

An embodiment of the light wall 100 is shown in FIG. 1. According to at least one embodiment, the light wall 100 includes the front wall 110 having a planar surface. The front wall 110 can be any size. Preferably, the front wall 110 is opaque. As shown in FIG. 1, the front wall 110 can include a plurality of circular openings 116. The plurality of circular openings 116 can be arranged in any manner along the front wall 110. Preferably, the plurality of circular openings 116 are in a grid-like pattern, evenly spaced horizontally and vertically across the entire area of the front wall 110. The plurality of circular openings 116 are preferably of uniform size and diameter. The plurality of circular openings 116 puncture the front wall 110, such that an object can pass from the outside face of the front wall 110 through the front wall 110 and past the inside face of the front wall 110.

The front wall 110 can be made of any type of solid material, including metal, acrylics, glass, polymers, wood, or a combination of the same. In an embodiment, the front wall 110 is manufactured from wood, preferably a thin wood. In another embodiment, the front wall 110 is made from #2025 black Plexiglas™. In another embodiment, the front wall 110 is made from acrylonitrile butadiene styrene (ABS) plastic. In an embodiment, the front wall 110 is made from polycarbonate. In another embodiment, the front wall 110 is made of aluminum. Preferably, the material selected for the front wall 110 can be selected based on the intended use of the liquid light wall 100. For example, a wood material may be appropriate for indoor use, but may not be acceptable for use outside. In an embodiment, the material is selected based on the portability of the finished article.

According to an embodiment, the front wall 110 can be any size. In an embodiment, the front wall 110 is approximately 7 feet, 6 inches in height. In an embodiment, the plurality of circular openings 116 are spaced 1 inch apart, and 0.5 inches from an edge of the front wall 110. In an embodiment, the plurality of circular openings 116 have a diameter in the range of 0.125 inches to 0.25 inches. Preferably, the plurality of circular openings 116 have a diameter of 0.1875 inches. In an embodiment, the front wall 110 is approximately 23.5 inches wide by 23.5 inches high. Preferably, the dimensions of the front wall 110 are such that the front wall 110 is rectangular or square.

(B) The Plurality of Pipettes

Figure 2:
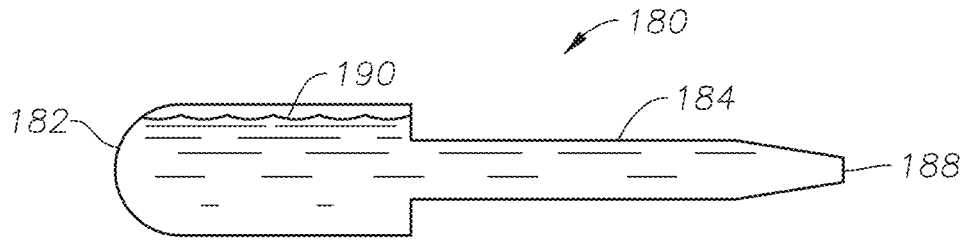
FIG. 2 is a representation of a pipette filled with liquid according to an embodiment.

According to at least one embodiment, the liquid light wall 100 includes a plurality of pipettes 180. The pipette 180 is shown in FIG. 2. The pipette 180 includes the pipette bulb 182. The pipette bulb 182 is an enclosed, preferably annular extension contiguous to the pipette stem 184. The pipette stem 184 is an elongated portion of the pipette 180. Preferably, the pipette bulb 182 has a diameter greater than the diameter of the pipette stem 184. In an embodiment, the pipette bulb 182 has a diameter of 9 mm (0.354 inches) and the pipette stem 184 has a diameter of 4.5 mm (0.177 inches). In another embodiment, the pipette bulb 182 has a diameter in the range of 0.17 inches to 0.5 inches. In an embodiment, the pipette stem 184 has a pipette opening 188 at the end opposite the pipette bulb 182. The pipette opening 188 is optional. The pipette opening 188 can be a smaller diameter than the diameter of the pipette stem 184. In an alternative embodiment, the pipette 180 is hermetically sealed. In another alternative embodiment, the pipette 180 is capped at either the pipette bulb 182 or the pipette stem 184.

According to at least one embodiment, the pipette stem 184 of the pipette 180 can be inserted inside one of the plurality of circular openings 116 of the front wall 110. Preferably, the pipette bulb 182 has a diameter slightly greater than the diameter of the plurality of circular openings 116, preventing the pipette 180 from fully passing through the circular opening 116, which secures the pipette 180 in the circular opening 116, but allows the pipette 180 to still be removable. According to an embodiment, the pipette bulb 182 can have a diameter substantially greater than the diameter of the circular openings 116. Preferably, when the pipette 180 is inserted into the circular opening 116, the pipette bulb 182 remains extended outward from the outside face of the front wall 110, while the pipette stem 184 extends through the circular opening 116 past the inside face of the front wall 110.

The pipettes 180 can be made of plastic, glass, rubber, wax, biodegradable materials, or a combination of the same. Preferably, the pipette 180 is made of plastic. In an embodiment, the pipette 180 is made of glass. Preferably, the pipette 180 is translucent. In an embodiment, the pipette 180 is made of polyethylene. In an embodiment, the pipette 180 has a volume that measures approximately 1.7 mL. Preferably, the pipette bulb 184 is flexible, allowing an individual to squeeze the pipette bulb 184 to release any contents contained therein.

According to an embodiment, the pipette 180 has a length of 3.5 inches, the pipette bulb 182 has a length of 1.0 inches, and the pipette stem 184 has a length of 2.5 inches. Preferably, the length of the pipette stem 184 is such that the pipette 180 is well balanced between the pipette bulb 182 positioned outside of the outside face of the front wall 110, and the pipette stem 184 positioned past the inside face of the front wall 110.

According to an embodiment, each of the pipettes 180 are filled with a liquid 190. In an embodiment, the pipettes 180 include air in addition to the liquid 190 inside the pipettes 180. In an embodiment, the pipettes 180 are only partially filled with the liquid 190. Preferably, the pipettes 180 are fully filled with the liquid 190, and little to no air remains in the pipettes 180. The liquid 190 can be any color, or be in the absence of color. The liquid 190 can be translucent, completely transparent, or opaque. Preferably, the liquid 190 is edible. The liquid 190 can be an alcoholic beverage, a non-alcoholic beverage, or another edible liquid. The pipettes 180 can be filled with the same variety of the liquid 190, or different varieties of the liquid 190. According to an embodiment, the liquid 190 is water, juice, liquor, beer, non-alcoholic beverages, or a combination of the same. Preferably, multiple assortments of the liquid 190 are provided for different groups of the pipettes 180, in various shades of color, pre-selected to form a specific design when the pipettes 180 are inserted into the plurality of circular openings 116. According to an embodiment, multiple assortments of the liquid 190 are provided in a variety of random colors.

Figure 3:
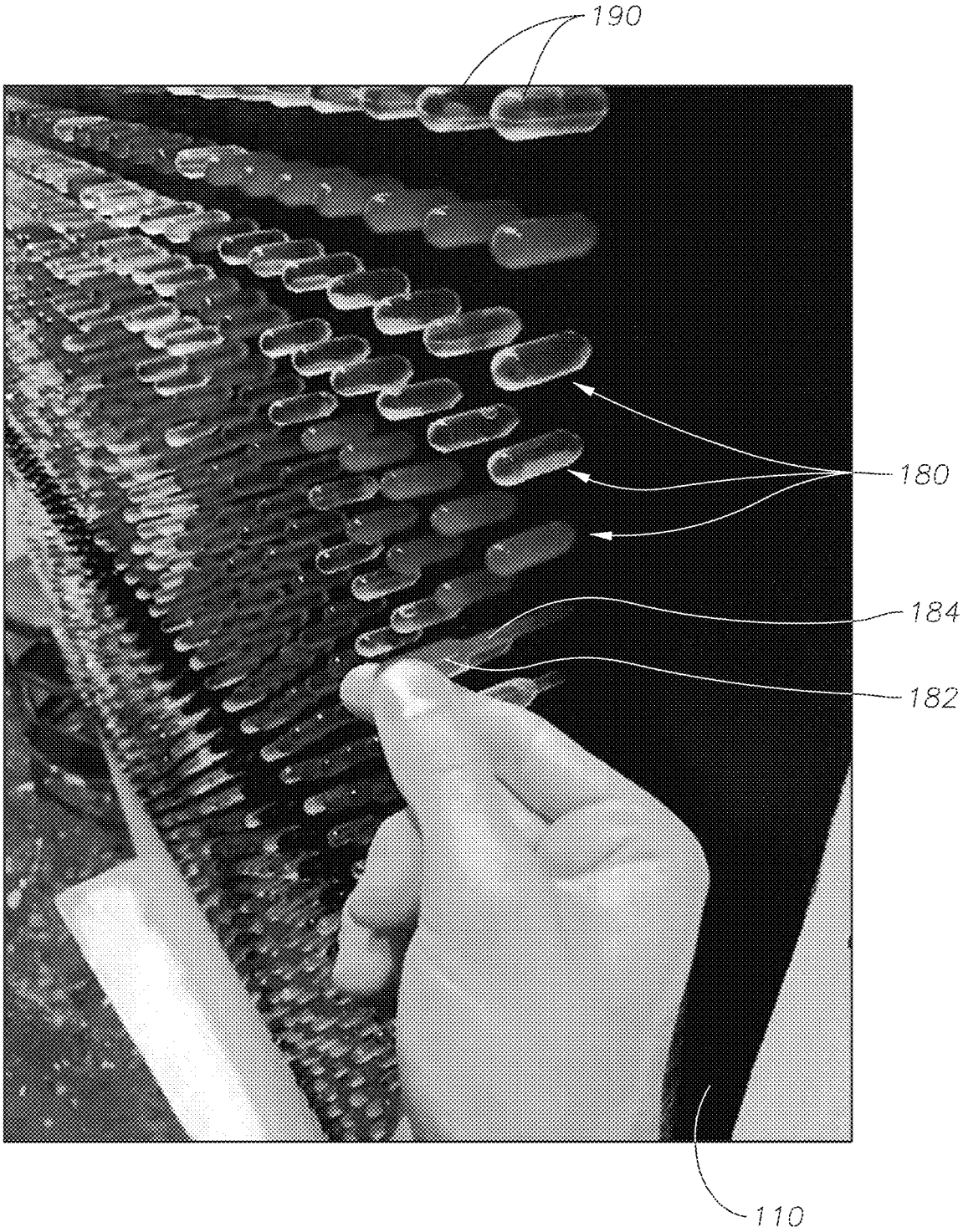
FIG. 3 is a photograph of an individual inserting a pipette filled with colored liquid into the liquid light wall according to an embodiment.

Referring to FIG. 3, a photo is provided showing the plurality of pipettes 180 inserted into the plurality of circular openings 116 of the front wall 110. A pipette stem 184 is shown being inserted into a respective circular opening 116 by an individual holding the pipette bulb 182.

According to an embodiment, the pipettes 180 filled with the liquid 190 of various colors are arranged according to a design. In an embodiment, an individual creates an image on the front wall 110 by positioning the pipettes 180 containing certain colors of the liquid 190 in the plurality of circular openings 116. The size of the front wall 110, the pipettes 180, and the detail required in the image can dictate whether the image appears pixilated or smooth and contiguous. The ability to generate an image in this fashion through an embodiment herein is of great advantage for marketing value.

According to an embodiment, the pipettes 180 filled with the liquid 190 are supplied outside of the liquid light wall, and individuals generate their own designs by inserting the pipette stem 184 into the plurality of circular openings 116.

According to an embodiment, individuals can remove the pipettes 180 from the circular openings 116 by grasping the pipette bulb 182 to consume the liquid 190. In an embodiment, the individual squeezes the pipette bulb 182 to release the liquid 190 for consumption.

(C) The Light Source

Figure 4:
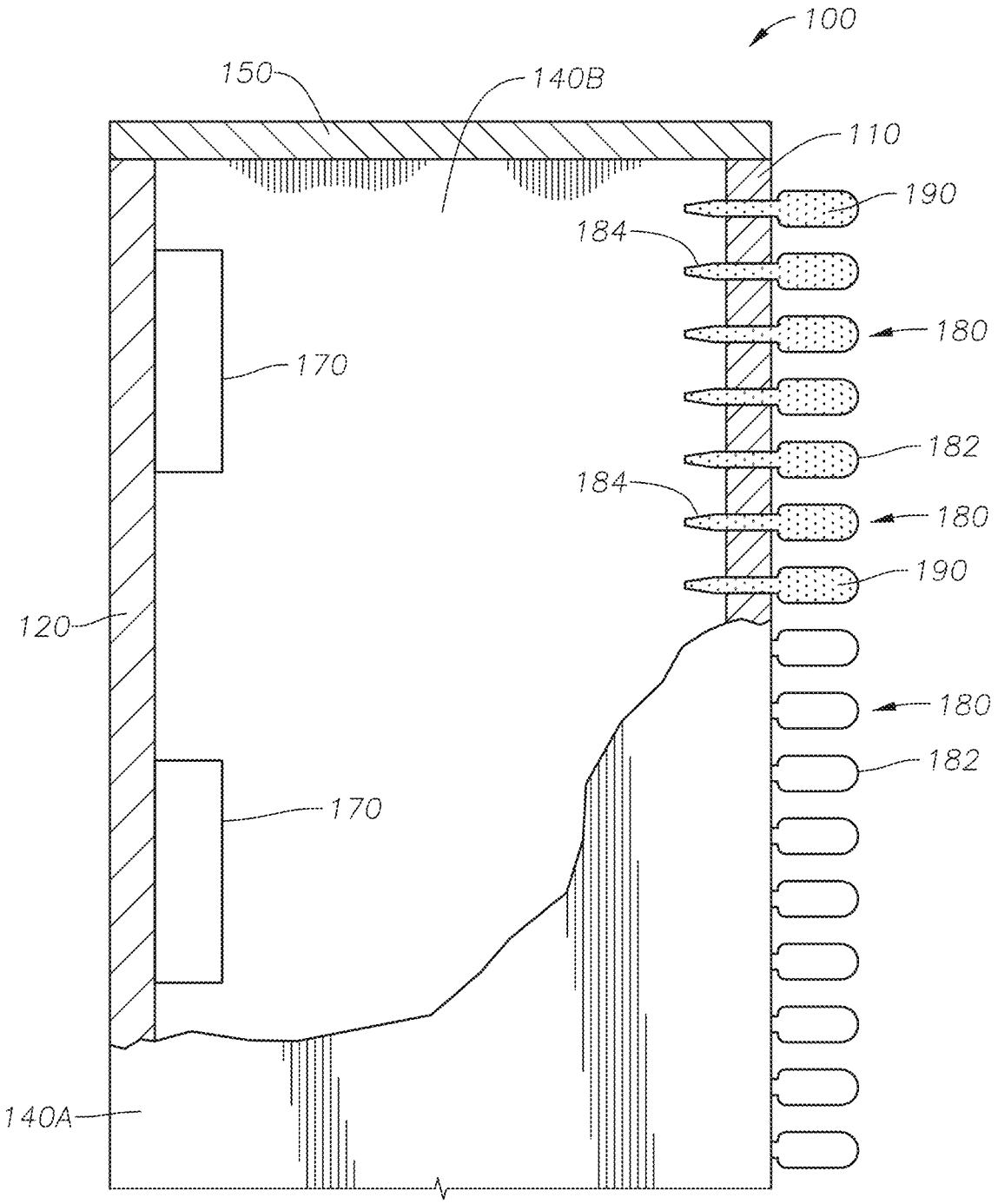
FIG. 4 is a partial cross-section of a side view of the liquid light wall with pipettes inserted according to an embodiment.

According to an embodiment, the light wall 100 includes a light source 170 as shown in FIGS. 1 and 4. The light source 170 generates visible light such that the light shines towards the inside face of the front wall 110. Light generated from the light source 170 then shines through the plurality of circular openings 116 and the pipettes 180 on the outside face of the front wall 110. According to an embodiment, the light generated from the light source 170 is transferred through the liquid 190, which is translucent and colored, and is seen by those on the outside face of the front wall 110 as a colored light. Preferably, the pipette bulbs 182, which can be seen on the outside face of the front wall 110, appear to glow. Therefore, in an embodiment, the pipettes 180 act like a colored or non-colored lightbulb, through which the light from the light source 170 can be seen. In essence, those in the art may refer to this style of lighting as being back lit.

According to an embodiment, since various colors of the liquid 190 are used in the pipettes 180 to generate a design on the front wall 110, the light from the light source 170 shines through the various colors of the pipette bulbs 182 generating a glowing design.

The light source 170 can be any type of source of light, including light-emitting diode (LED) lighting, incandescent bulb lighting, fluorescent bulb lighting, halogen bulb lighting, compact fluorescent lamp lighting, or a combination of the same. Preferably, the light source 170 includes LED lights. The light source 170 can be colored or non-colored. The light source 170 can be any range of Lumen output, wattage output, and Kelvin (K) output. Lumen output is the amount of light that a source of light produces. The higher the lumen number, the more light the source of light will produce. Wattage is the amount of electricity a source of light uses. The higher the wattage number, the more electricity a source of light will use. The Kelvin rating is a measure of the "color temperature," where a lower K value, such as 2,700, correlates to a warmer, yellowish light; a moderate K value, such as 4,500, produces a white light similar to daylight; and a higher K value, such as those above 5,000, produces a cooler, "blueish" light. According to an embodiment, the light source 170 is a warm light LED with a 3,000 K rating. According to an embodiment, the light source 170 is a white light with a 5,000 K rating. According to an embodiment, a plurality of the light source 170 is provided in a variety of colored LEDs, with a sequenced pattern display, where each of the LEDs are sequenced to turn on or off, change colors, or change luminosity, which creates a pattern, an image, or a message when programmed in sequence.

The light source 170 can be powered by a power source 175. FIG. 1 shows the light source 170 connected to the power source 175. The power source 175 is optional. The light source 170 can be connected to the power source 175 by any method known in the art. The power source 175 can be any source of power, including batteries, traditional grid-supplied power transferred through a wall outlet, AC power, DC power, or a combination of the same. In an embodiment, the power source 175 is rechargeable. Preferably, the power source 175 is portable. According to an embodiment, the power source 175 is a rechargeable, portable power supply that supplies all the needed electricity to the light source 170. According to an embodiment, the power source 175 is a 12 volt (v) deep cycle, sealed non-spillable batter with a minimum 20 ampere-hours (Amp-hr). In an embodiment, the power source 175 is an outside electrical source, such as an electricity source from a wall outlet, and a LED Driver waterproof IP67 Power Supply 150 watt 12 v DC 12.5a transformer with a US 3-prong plug plate is used to convert 12 v to 120 v power.

The light source 170 can be mounted or otherwise affixed to the back wall 120, the side walls 140, or other portions of the liquid light wall 100. The power source 175 can be mounted or otherwise affixed to the liquid light wall 100. In an embodiment, the light source 170 is not affixed but is separate from the liquid light wall 100. In an embodiment, the power source 175 is not affixed but is separate from the liquid light wall 100, and is only connected to the light source 170.

(D) The Side Walls

According to an embodiment, the liquid light wall 100 includes side walls 140. In an embodiment, there is a first side wall 140A and a second side wall 140B, which are interchangeable, as shown in FIGS. 1 and 4. Each of the edges of the side walls 140 are affixed approximately perpendicular to the front wall 110, one of each of the side walls 140A and 140B on each side of the front wall 110. The side walls 140 extend vertically along the side of the front wall 110. The side walls 140 are affixed parallel to each other on opposite sides of the front wall 110. The assembly of the side walls 140 and the front wall 110 forms a box-like structure, with the outside faces of the side walls 140 and the front wall 110 facing towards the outside of the box-like structure. The edge of the side wall 140 can lie flat against and be abutted to the inside face of the front wall 110, such that when an individual is facing the outside face of the front wall 110, the individual does not see the edge of the side wall 140. Alternatively, the inside face of the side wall 140 can be abutted to the outside edge of the front wall 110, such that when an individual is facing the outside face of the front wall 110, the individual can see the edge of the side wall 140. Alternatively, the edges of the front wall 110 and the side walls 140 can be beveled at a 45° angle, such that when the edges of the front wall 110 and the side walls 140 are placed together, a 90° angle is generated, and the outside faces of both the front wall 110 and the side wall 140 meet at the corner.

The front wall 110 and the side walls 140 can be permanently or temporarily affixed to each other by any method known in the art. Preferably, the selection of the method of affixing the side walls 140 and the front wall 110 is selected based on the material selected for the front wall 110 and the side walls 140, such that the method of affixing is appropriate for those materials. In an embodiment, adhesive bond glue, including Channel Bond Adhesive™ and SciGrip Weld™, are used to combine the Plexiglas™ material used on the front wall 110 and the side walls 140. According to an embodiment, a clear, water-thin solvent cement often used for welding acrylics is used to affix the front wall 110 and the side walls 140 together. In an embodiment, the front wall 110 and the side walls 140 are contiguous pieces made from one solid piece of material. In an embodiment, the front wall 110 and the side walls 140 are affixed by screws, nails, or other similar means.

The side walls 140 can be equipped with the side wall hatch 146 as shown in FIG. 1. The side wall hatch 146 is optional. In an embodiment, the side wall hatch 146 allows for access to the inside of the box-like structure created by assembling the front wall 110 and the side walls 140. The side wall hatch 146 can be flush with the side wall 140, or the side wall hatch 146 can extend outward from the side wall 140. Preferably, the side wall hatch 146 is inset in the side wall 140.

The side walls 140 can be made of any type of solid material, including metal, acrylics, glass, polymers, wood, or a combination of the same. Preferably, the side walls 140 are opaque. Preferably, the side walls 140 are made of the same material as the front wall 110. In an embodiment, the side walls 140 are made of a different material than the front wall 110. In an embodiment, the side walls 140 are manufactured from wood, preferably a thin wood. In an embodiment, the side walls 140 are made from #2025 black Plexiglas™. In an embodiment, the side walls 140 are made from ABS plastic. In an embodiment, the side walls 140 are made from polycarbonate. In an embodiment, the side walls 140 are made of aluminum. Preferably, the material selected for the side walls 140 can be selected based on the intended use of the liquid light wall 100. For example, a wood material may be appropriate for indoor use, but may not be acceptable for use outside. In an embodiment, the material is selected based on the portability of the finished article.

In an embodiment, the side walls are approximately the same height as the front wall 110. In an embodiment, the side walls 140 are approximately 18 inches in width and approximately 7 feet, 6 inches in height. In an embodiment, the side wall hatch 146 is approximately 12 inches in width and approximately 24 inches in height. In an embodiment, the side walls 140 are approximately 23.5 inches in height and approximately 3.8 inches in width.

(E) The Back Wall

According to an embodiment, the light wall 100 includes a back wall 120. Preferably, the back wall 120 is the same size as the front wall 110. In an embodiment, the back wall 120 is any size, and is a different size than the front wall 110. Preferably, the back wall 120 is opaque. Preferably, the back wall 120 is parallel and opposite to the front wall 110, and is perpendicular to the side walls 140, such that the inside face of the back wall 120 faces the inside face of the front wall 110. In an embodiment, the assembly of the side walls 140, the front wall 110, and the back wall 120 generates a box-like structure, with the outside faces of the side walls 140, the front wall 110, and the back wall 120 facing towards the outside of the box-like structure. The edge of the side wall 140 can lie flat against and be abutted against the inside face of the back wall 120, such that when an individual is facing the outside face of the back wall 120, the individual does not see the edge of the side wall 140. Alternatively, the edge of the side wall 140 can be abutted against the outside edge of the back wall 120, such that when an individual is facing the outside face of the back wall 120, the individual can see the edge of the side wall 140. Alternatively, the edges of the back wall 120 and the side walls 140 can be beveled at a 45° angle, such that when the edges of the back wall 120 and the side walls 140 are placed together, a 90° angle is generated, and the outside faces of both the back wall 120 and the side wall 140 meet at the corner.

According to an embodiment, the back wall 120 and the side walls 140 are not permanently affixed or one another. Preferably, the back wall 120 and the side walls 140 are affixed to one another. In an embodiment, the back wall 120 and the side walls 140 can be affixed to each other by any method known in the art. Preferably, the selection of the method of affixing the side walls 140 and the back wall 120 is selected based on the material selected for the back wall 120 and the side wall 140, such that the method of affixing is appropriate for those materials. In an embodiment, adhesive bond glue, including Channel Bond Adhesive™ and SciGrip Weld™, are used to combine the Plexiglas™ material used on the back wall 120 and the side walls 140. According to an embodiment, a clear, water-thin solvent cement often used for welding acrylics is used to affix the back wall 120 and the side walls 140 together. In an embodiment, the back wall 120 and the side walls 140 are contiguous pieces made from one solid piece of material. In an embodiment, the back wall 120 and the side walls 140 are affixed by screws, nails, or other similar means.

The back wall 120 can be made of any type of solid material, including metal, acrylics, glass, polymers, wood, or a combination of the same. Preferably, the back wall 120 is opaque. Preferably, the back wall 120 is made of the same material as the front wall 110 or the side walls 140. In an embodiment, the back wall 120 is made of a different material than the front wall 110 or the side walls 140. In an embodiment, the back wall 120 is manufactured from wood, preferably a thin wood. In an embodiment, the back wall 120 is made from #2025 black Plexiglas™. In an embodiment, the back wall 120 is made from ABS plastic. In an embodiment, the back wall 120 is made from polycarbonate. In an embodiment, the back wall 120 is made of aluminum. Preferably, the material selected for the back wall 120 can be selected based on the intended use of the liquid light wall 100. For example, a wood material may be appropriate for indoor use, but may not be acceptable for use outside. In an embodiment, the material is selected based on the portability of the finished article.

According to an embodiment, a support structure can be used inside of the box-like structure of the liquid light wall 100 generated by the front wall 110, the side walls 140, and the back wall 120. In an embodiment, the support structure is used to provide additional support inside the liquid light wall 100, such that the liquid light wall 110 can be sturdy, portable, durable, and stable. In an embodiment, the support structure helps the liquid light wall 100 stand upright. In an embodiment, the support structures are galvanized metal studs affixed to the inside face of the front wall 110 or the back wall 120. According to an embodiment, the support structures are made of polyvinyl chloride (PVC) affixed to the inside face of the front wall 110 or the back wall 120.

Referring to FIG. 4, an embodiment of the liquid light wall 100 is shown in a partial cross-section with the front wall 110 opposed to the back wall 120, the plurality of the pipettes 180 in the plurality of circular openings 116 of the front wall 110. In an embodiment, the light source 170 is affixed to the back wall 120, positioned such that light from the light sources 170 can shine through the pipettes 180. The pipette stems 184 are shown extending through the plurality of circular openings 116 of the front wall 110, with the pipette bulbs 182 filled with the liquid 190 extending outside of the front face of the front wall 110. The side walls 140 (shown as the side wall 140A and the side wall 140B, which are interchangeable) are also shown in FIG. 4.

(F) The Top Wall

In an embodiment, the liquid light wall 100 also includes a top wall 150 as shown in FIGS. 4, 5A-5B, and 6E. In an embodiment, the top wall 150 is positioned perpendicular to the front wall 110 and perpendicular to the back wall 120, as well as perpendicular to the side walls 140. Preferably, the top wall 150 is positioned such that the front wall 110, the back wall 120, the side walls 140, and the top wall 150 generates the box-like structure, with the outside faces of the side walls 140, the front wall 110, the back wall 120, and the top wall 150 facing towards the outside of the box-like structure. In an embodiment, the inside face of the top wall 150 faces the inside of the box-like structure.

According to an embodiment, the top wall 150 can be any size. Preferably, the top wall 150 is the same width as the side walls 140, and the same length as the front wall 110, such that the top wall 150 encloses the box-like structure without overhang. In an embodiment, the edge of the top wall 150 lies flat against and is abutted to the inside face of the front wall 110, such that when an individual is facing the outside face of the front wall 110, the individual does not see the edge of the top wall 150. In an embodiment, the inside face of the top wall 150 is abutted to the outside edge of the front wall 110, such that when an individual is facing the outside face of the front wall 110, the individual can see the edge of the top wall 150. In an embodiment, the edges of the top wall 150 and the front wall 110 are beveled at a 45° angle, such that when the edges of the top wall 150 and the front wall 110 are placed together, a 90° angle is generated, and the outside faces of both the front wall 110 and the top wall 150 meet at the corner. The top wall 150 can be similarly positioned along the edges of the side walls 140 and the back wall 120. The top wall 150 can be similarly positioned along the edges of the side walls 140 and the back wall 120 in the same or different manner.

According to an embodiment, the top wall 150, the front wall 110, the side walls 140, or the back wall 12 are not permanently affixed or one another. According to an embodiment, the top wall 150 and the side walls 140, the back wall 120, or the front wall 110 are affixed. The top wall 150 and the side walls 140, the back wall 120, or the front wall 110 can be affixed to each other by any method known in the art. According to an embodiment, the selection of the method of affixing the top wall 150 to the side walls 140, the back wall 120, or the front wall 110 is selected based on the material selected for the top wall 150, such that the method of affixing is appropriate for those materials. In an embodiment, adhesive bond glue, including Channel Bond Adhesive™ and SciGrip Weld™ are used to combine the Plexiglas™ material used on the top wall 150 and the side walls 140, the front wall 110, and the back wall 120. According to an embodiment, a clear, water-thin solvent cement often used for welding acrylics is used to affix the top wall 150 to the side walls 140, the front wall 110, and the back wall 120. In an embodiment, the top wall 150 and the side walls 140, the front wall 110, or the back wall 120 are contiguous pieces made from one solid piece of material. In an embodiment, the top wall 150 and the side walls 140, the front wall 110, or the back wall 120 are affixed by screws, nails, or other similar means.

The top wall 150 can be made of any type of solid material, including metal, acrylics, glass, polymers, wood, or a combination of the same. Preferably, the top wall 150 is opaque. Preferably, the top wall 150 is made of the same material as the front wall 110, the side walls 140, or the back wall 120. In an embodiment, the top wall 150 is made of a different material than the front wall 110, the side walls 140, and the back wall 120. In an embodiment, the top wall 150 is manufactured from wood, preferably a thin wood. In an embodiment, the top wall 150 is made from #2025 black Plexiglas™. In an embodiment, the top wall 150 is made from ABS plastic. In an embodiment, the top wall 150 is made from polycarbonate. In an embodiment, the top wall 150 is made of aluminum. Preferably, the material selected for the top wall 150 can be selected based on the intended use of the finished article. For example, a wood material may be appropriate for indoor use, but may not be acceptable for use outside. In an embodiment, the material is selected based on the portability of the finished article.

(G) The Bottom Wall

Figure 5A:
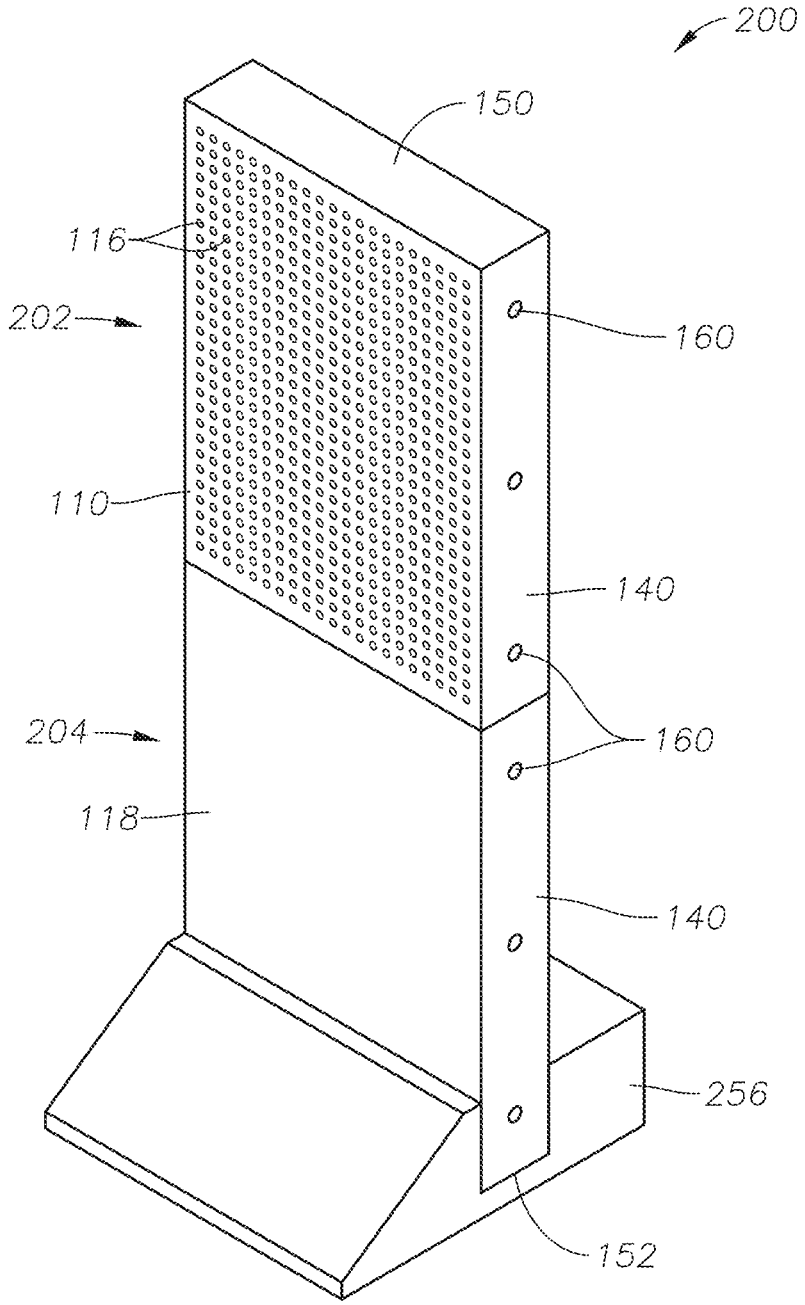
FIG. 5A is a representation of the liquid light wall module according to an embodiment.
Figure 5B:
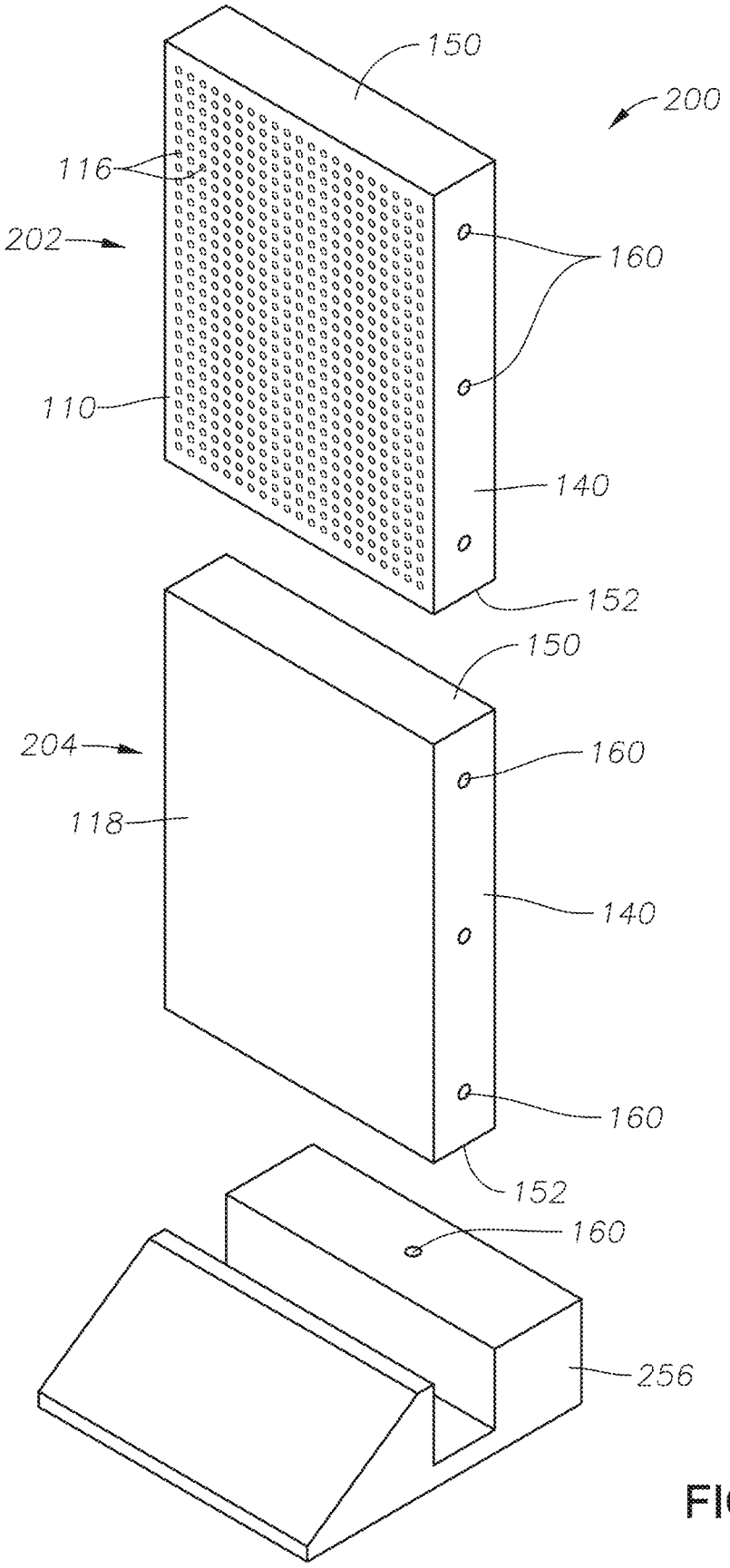
FIG. 5B is an exploded view of the representation of the liquid light wall module according to an embodiment.
Figure 10:
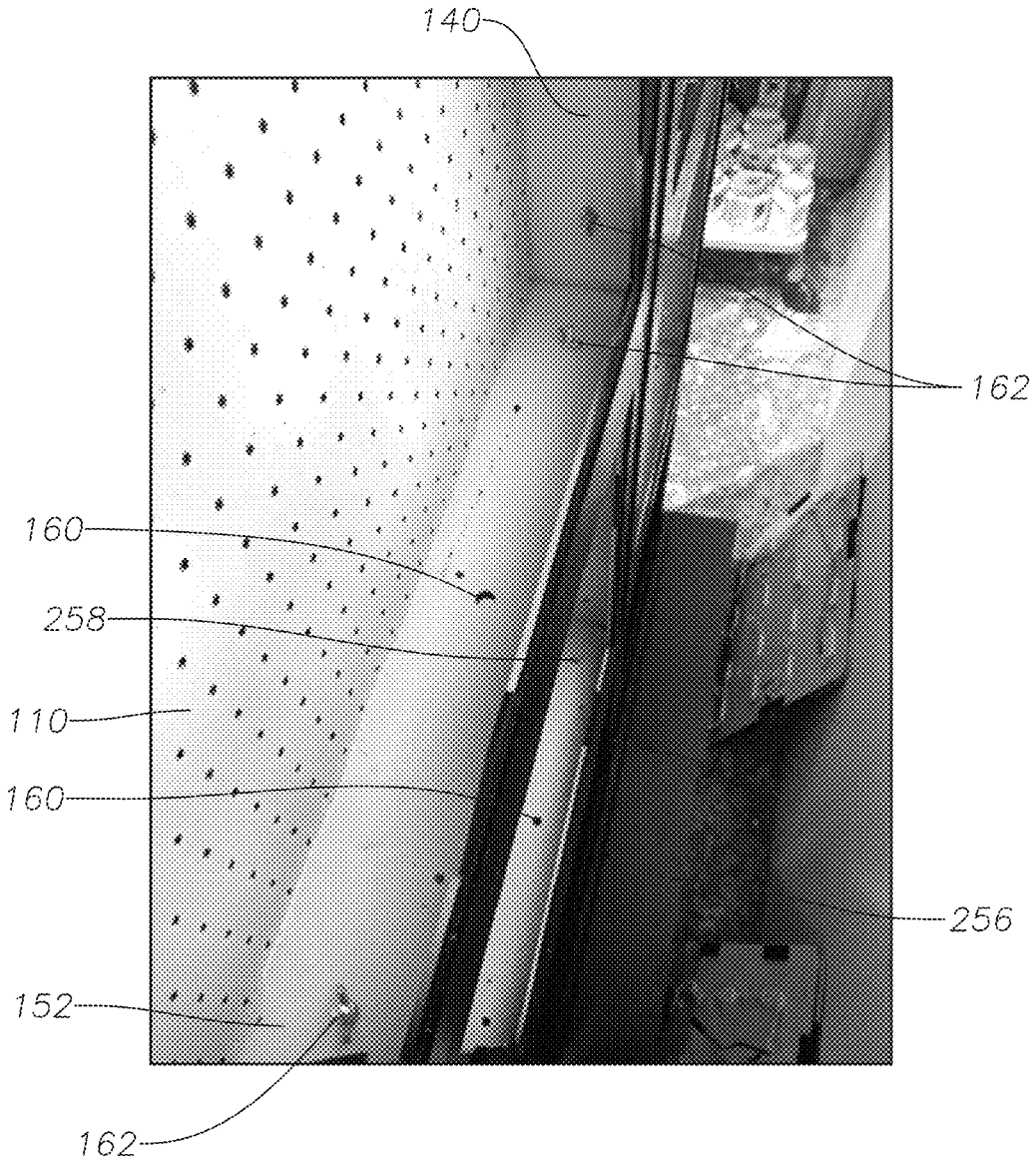
FIG. 10 is a photograph of a back view of the inside of the liquid light wall module according to an embodiment.

The liquid light wall 100 can also have a bottom wall 152 as shown in FIGS. 5A, 5B, and 10. According to an embodiment, the bottom wall 152 can be positioned perpendicular to the front wall 110 and perpendicular to the back wall 120, as well as perpendicular to the side walls 140, such that the bottom wall 152 is positioned parallel and opposite to the top wall 150. In an embodiment, the bottom wall 152 is positioned such that the front wall 110, the back wall 120, the side walls 140, the top wall 150, and the bottom wall 152 generates the enclosed box-like structure, with the outside faces of the side walls 140, the front wall 110, the back wall 120, the top wall 150, and the bottom wall 152 facing towards the outside of the box-like structure, and the inside face of the bottom wall 152 faces the inside of the box-like structure.

The bottom wall 152 can be any size. Preferably, the bottom wall 152 is the same width as the side walls 140, and the same length as the front wall 110, such that the bottom wall 152 encloses the box-like structure without overhang. In an embodiment, the edge of the bottom wall 152 lies flat against and is abutted to the inside face of the front wall 110, such that when an individual is facing the outside face of the front wall 110, the individual does not see the edge of the bottom wall 152. In an embodiment, the inside face of the bottom wall 152 is abutted to the outside edge of the front wall 110, such that when an individual is facing the outside face of the front wall 110, the individual can see the edge of the bottom wall 152. According to an embodiment, the edges of the bottom wall 152 and the front wall 110 are beveled at a 45° angle, such that when the edges of the bottom wall 152 and the front wall 110 are placed together, a 90° angle is generated, and the outside faces of both the front wall 110 and the bottom wall 152 meet at the corner. The bottom wall 152 can be similarly positioned along the edges of the side walls 140 and the back wall 120 in the same or different manner.

According to an embodiment, the bottom wall 152, the front wall 110, the side walls 140, or the back wall 120 are not permanently affixed or one another. According to an embodiment, the bottom wall 152 and the side walls 140, or the back wall 120, or the front wall 110 are affixed. The bottom wall 152 and the side walls 140, or the back wall 120, or the front wall 110 can be affixed to each other by any method known in the art. According to an embodiment, the selection of the method of affixing the bottom wall 152 to the side walls 140, the back wall 120, or the front wall 110 is selected based on the material selected for the bottom wall 152, such that the method of affixing is appropriate for those materials. In an embodiment, adhesive bond glue, including Channel Bond Adhesive™ and SciGrip Weld™, are used to combine the Plexiglas™ material used on the bottom wall 152 and the side walls 140, the front wall 110, and the back wall 120. According to an embodiment, a clear, water-thin solvent cement often used for welding acrylics is used to affix the bottom wall 152 to the side walls 140, the front wall 110, and the back wall 120. In an embodiment, the bottom wall 152 and the side walls 140, the front wall 110, or the back wall 150 are contiguous pieces made from one solid piece of material. In an embodiment, the bottom wall 152 and the side walls 140, the front wall 110, or the back wall 150 are affixed by screws, nails, or other similar means.

The bottom wall 152 can be made of any type of solid material, including metal, acrylics, glass, polymers, wood, or a combination of the same. In an embodiment, the bottom wall 152 is opaque. In an embodiment, the bottom wall 152 is made of the same material as the front wall 110, the side walls 140, the top wall 150, or the back wall 120. In an embodiment, the bottom wall 152 is made of a different material than the front wall 110, the side walls 140, the back wall 120, or the top wall 150. In an embodiment, the bottom wall 152 is manufactured from wood, preferably a thin wood. In an embodiment, the bottom wall 152 is made from #2025 black Plexiglas™. In an embodiment, the bottom wall 152 is made from ABS plastic. In an embodiment, the bottom wall 152 is made from polycarbonate. In an embodiment, the bottom wall 152 is made of aluminum. Preferably, the material selected for the bottom wall 152 is selected based on the intended use of the liquid light wall module 200. For example, a wood material may be appropriate for indoor use, but may not be acceptable for use outside. In an embodiment, the material is selected based on the portability of the finished article.

(H) The Illuminated Module

According to an embodiment, the light wall can be in a modular form. An embodiment of the liquid light wall module 200 is shown in FIG. 5A. An exploded view of an embodiment of the liquid light wall module 200 is shown in FIG. 5B. Preferably, the liquid light wall module 200 includes the illuminated module 202. According to an embodiment, the liquid light wall module 200 also includes the non-illuminated module 204.

In an embodiment, the modular form of the liquid light wall module provides many advantages, including versatility, portability, and storability. In an embodiment, a plurality of the illuminated modules can be placed side by side, horizontally or vertically, generating a large area or structure. In an embodiment, a plurality of the illuminated modules and one or more of the non-illuminated modules can be placed side by side, horizontally or vertically, generating a large area or structure.

Figure 6A:
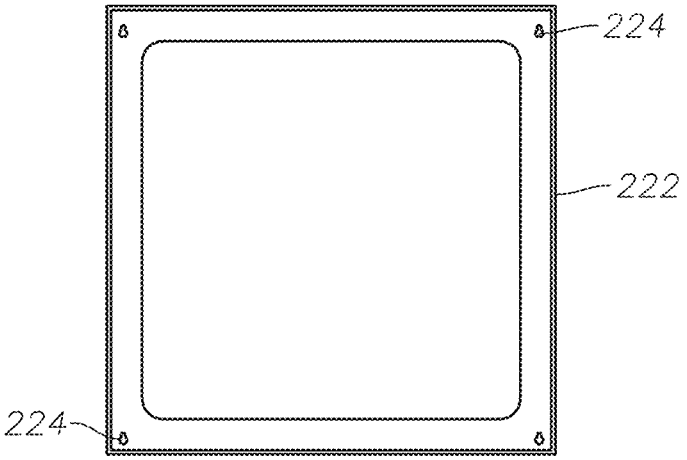
FIG. 6A is a representation of the fixed backing of the back wall of the liquid light wall module according to an embodiment.

According to an embodiment, and as shown in FIGS. 5A and 5B, the illuminated module 202 includes the front wall 110, the back wall 120, and the side walls 140. According to another embodiment, the illuminated module 202 includes the front wall 110, the back wall 120, the side walls 140, the bottom wall 150, and the top wall 152. Preferably, the front wall 110 includes the plurality of circular openings 116. In an embodiment, the front wall 110, the back wall 120, and the side walls 140 of the illuminated module 202 can have the same characteristics as those for the liquid light wall 100. FIG. 6D shows an embodiment of the side walls 140 of the illuminated module 202. FIG. 6E shows an embodiment of the bottom wall 150 of the illuminated module 202.

Figure 6B:
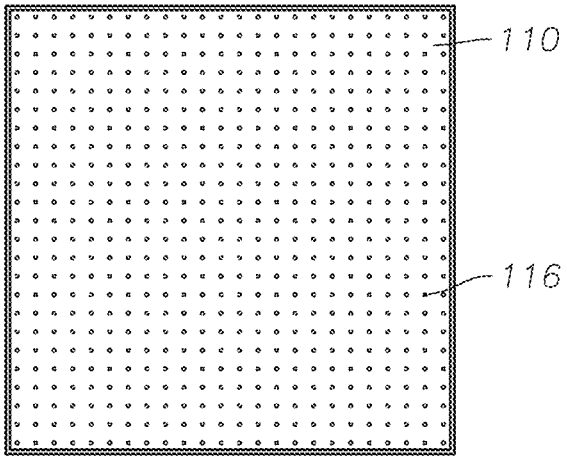
FIG. 6B is a representation of the front wall of the liquid light wall module according to an embodiment.

According to an embodiment, the illuminated module 202 includes 576 of the circular openings 116 evenly spaced as shown in FIG. 6B. According to an embodiment, the illuminated module 202 includes the plurality of circular openings 116 evenly spaced at a distance of 1 inch from the center of a first circular opening 116 to the center of a second circular opening 116 in either the vertical or horizontal directions across the front wall 110, with the center of the circular openings 116 nearest to an edge of the front wall 110 positioned 0.5 inches from the edge of the front wall 110. In an embodiment, the 0.5 inch spacing nearest the edge of the front wall 110 allows for a consistent 1 inch spacing between the circular openings 116 when more than one of the illuminated modules 202 are placed abutted to each other. In an embodiment, the illuminated module 202 includes the plurality of circular openings 116 arranged in a grid-like pattern, with 24 of the circular openings 116 across the horizontal portion of the front wall 110, and the illuminated module 202 includes 24 of the circular openings 116 across the vertical portion of the front wall 110, for a total of 576 of the circular openings 116.

According to an embodiment, the illuminated module 202 can be a fully enclosed structure, with the top wall 150 and the bottom wall 152. The top wall 150 in the illuminated module 202 can have the same characteristics as the top wall 150 for the liquid light wall 100. The bottom wall 152 in the illuminated module 202 can have the same characteristics as the bottom wall 152 for the liquid light wall 100.

Figure 6C:
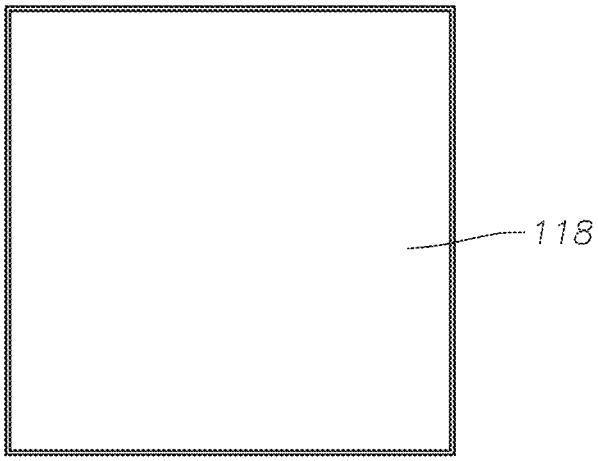
FIG. 6C is a representation of the solid wall of the liquid light wall modules according to an embodiment.
Figure 6D:
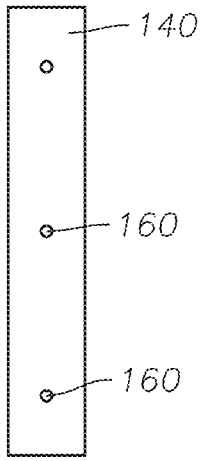
FIG. 6D is a representation of the side wall of the liquid light wall module according to an embodiment.
Figure 6E:
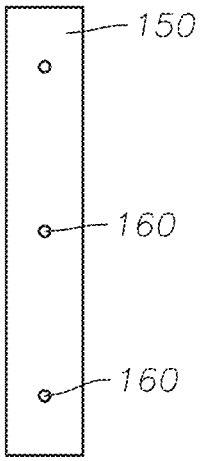
FIG. 6E is a representation of the side wall of the liquid light wall module according to an embodiment.
Figure 6F:
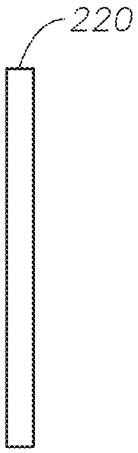
FIG. 6F is a representation of the backing support of the liquid light wall module according to an embodiment.
Figure 6G:
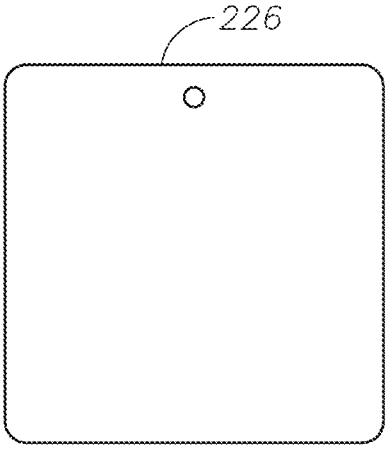
FIG. 6G is a representation of the detachable cover of the liquid light wall module according to an embodiment.
Figure 7:
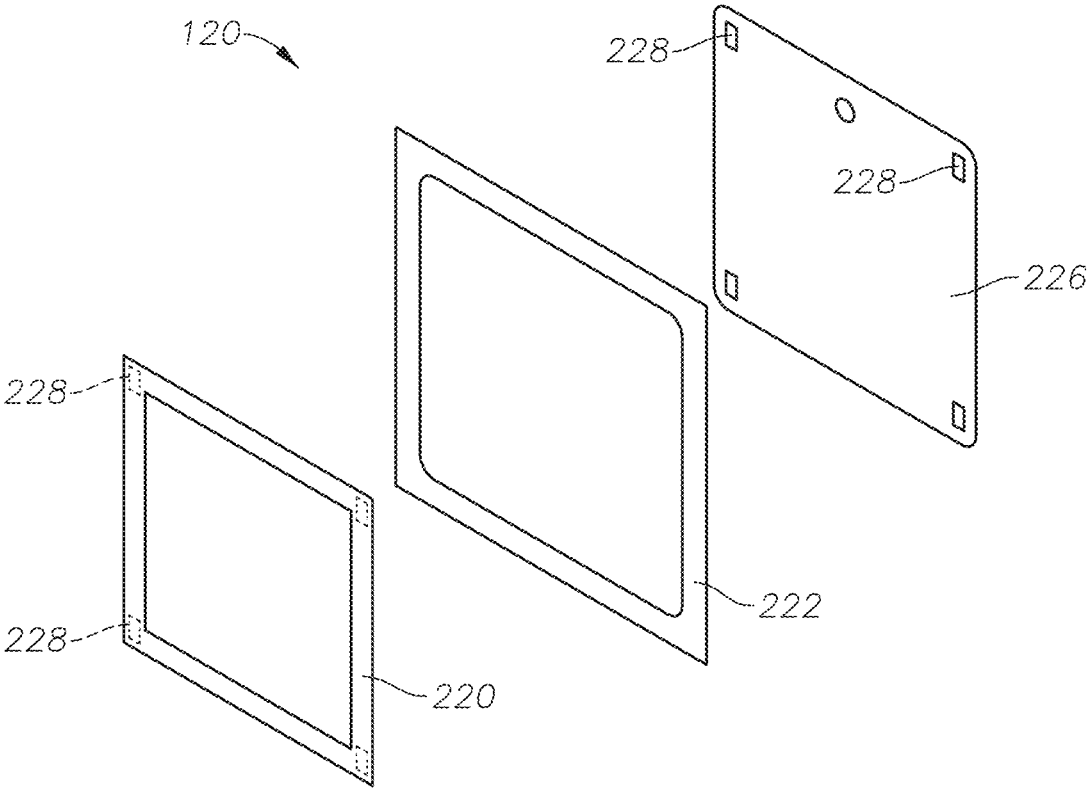
FIG. 7 is an exploded view of a representation of the back wall of the liquid light wall module according to an embodiment.

According to an embodiment, the back wall 120 of the liquid light wall module 200 includes a backing support 220, a fixed backing 222, and a detachable cover 226, as shown in FIGS. 6A, 6F, and 6G. An exploded view of an embodiment of the back wall 120 including the backing support 220, the fixed backing 222, and the detachable cover 226 is shown in FIG. 7. In an embodiment, the fixed backing 222 is affixed to the side walls 140, the top wall 150, and the bottom wall 152. Preferably, the fixed backing 222 includes a cut-out area. In an embodiment, the detachable cover 226 fits into the cut-out area of the fixed backing 222. In an embodiment, the detachable cover 226 is flush with the fixed backing 222 such that the outside face of the back wall 120 is smooth. In an embodiment, the detachable backing 226 includes a small opening, knob, or other fixture to allow for an individual to grasp the detachable cover 226 and remove it from the back wall 120.

In an embodiment, the fixed backing 222 includes one or more mounting holes 224. The one or more mounting holes 224 can be used to affix the liquid light wall module 200 to a surface, such as a wall.

According to an embodiment, the backing support 220 is affixed perpendicular to the side walls 140, the top wall 150, and the bottom wall 152. In an embodiment, the backing support 220 provides structural support for the fixed backing 222 and the detachable cover 226 and allows for a flush, even surface of the back wall 120. According to an embodiment, the detachable backing 226 is affixed to the backing support 220 by a cover attachment mechanism 228. The cover attachment mechanism 228 can be any method known in the art which can allow the detachable cover 226 to be secured but removable. In an embodiment, the cover attachment mechanism 228 is 4 hook and loop Velcro™ strip pairs approximately 1 inch wide by 3 inches long placed on each side of the outside face of the backing support 220 and on the corresponding locations on the inside face of the detachable cover 226.

Figure 9:
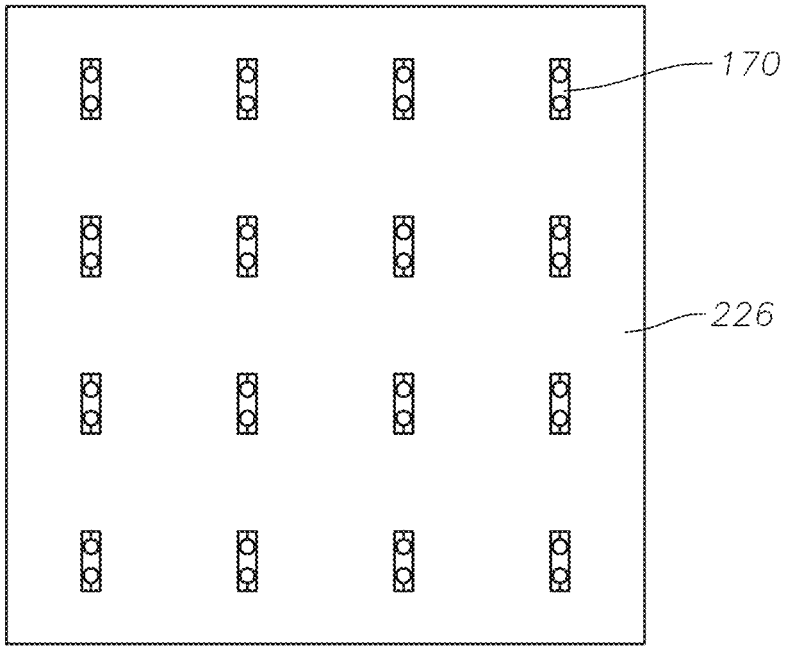
FIG. 9 is a representation of the detachable cover with the light source according to an embodiment.

According to an embodiment, the illuminated module 202 includes the light source 170. According to an embodiment, the light source 170 is mounted on the inside face of the detachable cover 226. In an embodiment, the light source 170 mounted on the inside face of the detachable cover 226 includes 1 LED section per 6×6 inch square of the back wall 120, as shown in FIG. 9.

According to an embodiment, the side walls 140, the top wall 150, and the bottom wall 152 of the illuminated module 202 include one or more access openings 160, as shown in FIGS. 5A-5B, 6D, 6E, and 10. In an embodiment, the one or more access openings 160 allow for wires or cords from the inside of the illuminated module 202 to pass outside of the illuminate module 202. According to an embodiment, some of the one or more access openings 160 are used along with an interlocking mechanism 162 to connect one of the illuminated modules 202 to another of the illuminated modules 202 or a non-illuminated module 204, as shown in FIG. 10. The interlocking mechanism 162 can be any type of mechanism that can connect the illuminated modules 202 or the non-illuminated modules 204 to one another. In an embodiment, the interlocking mechanism 162 is a nut and bolt. In an embodiment, the interlocking mechanism 162 is a ¼-20×1 inch wing bolt and nut.

According to an embodiment, each of the side walls 140, the top wall 150, and the bottom wall 152 have 3 access openings 160. The access openings 160 can be different sizes or diameters. According to an embodiment, the access opening 160 positioned in the center of the side walls 140, the top wall 150, and the bottom wall 152 has a larger diameter than the other of the access openings 160, allowing for wires from the inside of the illuminated module 202 to pass outside of the illuminate module 202. According to an embodiment, the outermost of the access openings 160 in each of the side walls 140, the top wall 150, and the bottom wall 152 are used with the interlocking mechanism 162 to attach one of the illuminated modules 202 to another of the illuminated modules 202, or to another of the non-illuminated modules 204.

(G) The Non-Illuminated Module

According to an embodiment, the liquid light wall module 200 can include the non-illuminated module 204, as shown in FIGS. 5A and 5B. According to an embodiment, the non-illuminated module 204 can include a solid front wall 118, the back wall 120, and the side walls 140. Preferably, the solid wall 118 is a planar, solid surface. In an embodiment, the solid front wall 118 is in the absence of the plurality of circular openings 116, as shown in FIG. 6C. The solid front wall 118 can have the same characteristics as the front wall 110, except with the absence of the plurality of circular openings 116.

In an embodiment, the non-illuminated module 204 is configured in the same manner as the illuminated module 202. In an embodiment, the back wall 120 and the side walls 140 of the non-illuminated module 204 can have the same characteristics as those for the illuminated module 202. In an embodiment, the non-illuminated module 204 can include the top wall 150 and the bottom wall 152. In an embodiment, the non-illuminated module 204 includes the back wall 120. The top wall 150, the bottom wall 152, and the back wall 120 of the non-illuminated module 204 can have the same characteristics as those in the illuminated module 202. FIGS. 6D and 6E show an embodiment of the side walls 140 of the non-illuminated module 204.

According to an embodiment, the non-illuminated module 204 can have the power source 175 affixed or placed inside of the non-illuminated module 204.

According to an embodiment, the side walls 140, the top wall 150, and the bottom wall 152 of the non-illuminated module 204 include one or more access openings 160. The one or more access openings 160 can allow for wires from the inside of the non-illuminated module 204 to pass outside of the non-illuminated module 204. According to an embodiment, some of the access openings 160 are used along with an interlocking mechanism 162 to connect one of the non-illuminated modules 204 to another of the illuminated modules 202 or the non-illuminated modules 204. The interlocking mechanism 162 can be any type of mechanism that can connect the illuminated modules 202 or the non-illuminated modules 204 to one another. In an embodiment, the interlocking mechanism 162 is a nut and bolt. In an embodiment, the interlocking mechanism 162 is a ¼-20×1 inch wing bolt and nut.

(H) The Base Assembly

Figure 8:
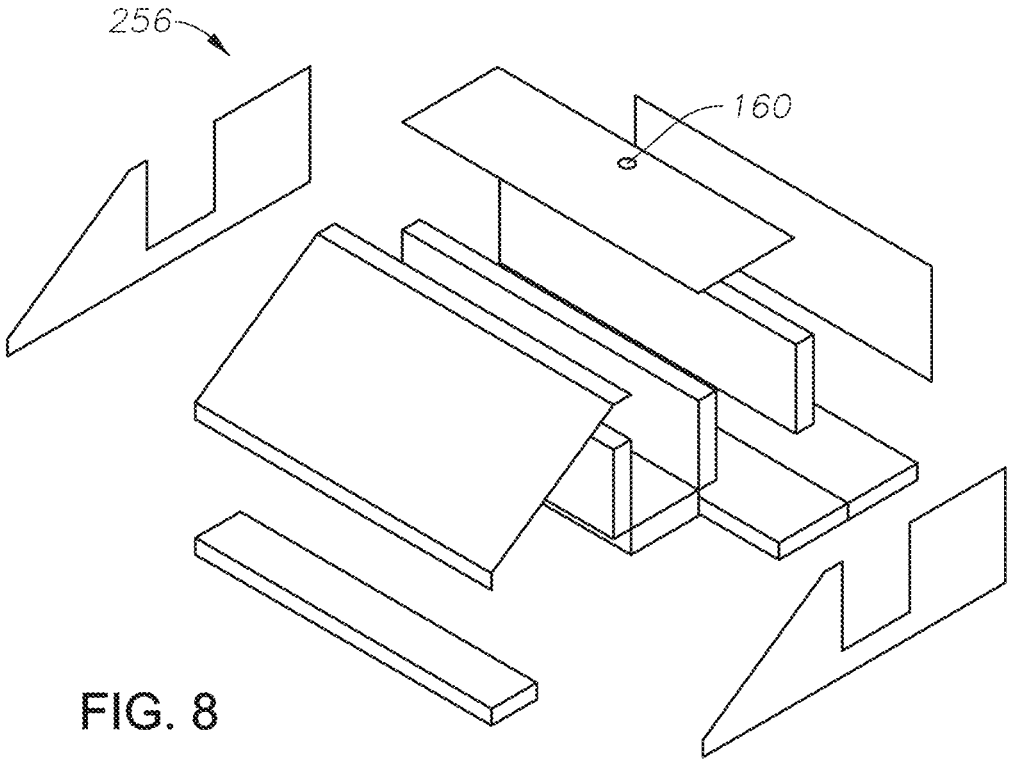
FIG. 8 is an exploded view of a representation of the base assembly according to an embodiment.

According to an embodiment, the liquid light wall 100 or the liquid light module 200 has a base assembly 256. An embodiment of the base assembly 256 is shown in FIGS. 5A and 5B. An exploded view of an embodiment of the base assembly 256 is shown in FIG. 8. The base assembly 256 can be any size, shape, or design such that the base assembly 256 provides support and stability to the illuminated modules 202, the non-illuminated modules 204, or the box-like structure of the liquid light wall 100.

According to an embodiment, the base assembly 256 can be a fully enclosed structure. In an embodiment, the base assembly 256 cradles a portion of the front wall 110 and a portion of the back wall 120, such that a portion of the front wall 110 and a portion of the back wall 120 are covered by the base assembly. In an embodiment, the outside face of the bottom wall 152 abuts a flat portion of the base assembly 256.

The base assembly 256 can be made of any type of solid material, including metal, acrylics, glass, polymers, wood, or a combination of the same. Preferably, the base assembly 256 is opaque. Preferably, the base assembly 256 is made of the same material as the front wall 110, the side walls 140, the back wall 120, the bottom wall 152, or the top wall 150. In an embodiment, the base assembly 256 can be made of a different material than the front wall 110, the side walls 140, the back wall 120, the bottom wall 152, or the top wall 150. In an embodiment, the base assembly 256 is manufactured from wood, preferably a thin wood. In an embodiment, the base assembly 256 is made from #2025 black Plexiglas™. In an embodiment, the base assembly 256 is made from ABS plastic. In an embodiment, the base assembly 256 is made from polycarbonate. In an embodiment, the base assembly 256 is made of aluminum. The material selected for the base assembly 256 can be selected based on the intended use of the base assembly. For example, a wood material may be appropriate for indoor use, but may not be acceptable for use outside. In an embodiment, the material is selected based on the portability of the finished article.

According to an embodiment, the base assembly 256 includes one or more access openings 160. In an embodiment, the one or more access openings 160 allow for wires and cords from the inside of the illuminated module 202 or the non-illuminated module 204 or the power source 175 to pass through the base assembly 256.

According to an embodiment, some of the one or more access openings 160 of the base assembly 256 are used along with a base attachment mechanism 258 to connect the bottom wall 152 of the illuminated modules 202, the non-illuminated module 204, or the liquid light wall 100 to the base assembly 256, as shown in FIG. 10. The base attachment mechanism 258 can be any type of mechanism that connects the bottom wall 152 to the base assembly 256. In an embodiment, the base attachment mechanism 258 is a nut and bolt. In an embodiment, the base attachment mechanism 258 is a ¼-20×1 inch wing bolt and nut.

The base assembly 256 can be attached to the front wall 110, the back wall 120, the side walls 140, or the bottom wall 152 by any method known in the art. In an embodiment, the base assembly 256 is permanently affixed to the front wall 110, the back wall 120, the side walls 140, or the bottom wall 152. In an embodiment, the base assembly 256 is temporarily affixed to the front wall 110, the back wall 120, the side walls 140, or the bottom wall 152. In an embodiment, the method of attaching the base assembly 256 to the front wall 110, the back wall 120, the side walls 140, or the bottom wall 152 is selected based on the material selected for the base assembly 256, the front wall 110, the back wall 120, the side walls 140, and the bottom wall 152. In an embodiment, the base assembly 256 and the side walls 140, the front wall 110, the bottom wall 152, or the back wall 150 are affixed by screws, nails, or other similar means.

In an embodiment, adhesive bond glue, including Channel Bond Adhesive™ and SciGrip Weld™, are used to affix the Plexiglas™ material used on the base assembly 256, the side walls 140, the front wall 110, the back wall 120, or the bottom wall 152. According to an embodiment, a clear, water-thin solvent cement often used for welding acrylics is used to affix the base assembly 256 to the side walls 140, the front wall 110, the back wall 120, or the bottom wall 152.

The base assembly 256 can be any size. In an embodiment, the width of the base assembly 256 is the same width as the front wall 110, such that the front wall 110 does not overhang the edges of the base assembly 256, nor does the base assembly edges extend past the front wall 110.

Embodiments of the liquid light wall modules and the liquid light wall provide advantages over other articles in the art. The embodiments are portable, and can be transported easily, assembled in a timely fashion, and removed quickly. The embodiments are versatile, and can be modified easily for the venue space and mounting abilities, as well as the light source or power sources available. The embodiments are multipurpose, providing entertainment, marketing value, interaction, artistic expression, decoration, and beverage service. The embodiments are versatile options for events, as they have multiple options for entertainment, color, beverage, and activity.

The invention claimed is:

1. An apparatus for generating illuminated designs in a liquid light wall, the apparatus comprising:

a front wall, comprising a plurality of circular openings, each circular opening traversing through from an outside face of the front wall to an inside face of the front wall, and each circular opening having a circular opening diameter;

a back wall, opposed to the front wall;

side walls, perpendicularly abutting the front wall and the back wall, such that the front wall, the back wall, and the side walls form a box-like structure;

a light source, placed inside the box-like structure; and a plurality of pipettes, each pipette comprising a pipette bulb and a pipette stem, wherein the pipette bulb has a diameter wider than a diameter of the pipette stem;

wherein each pipette is inserted into one of the plurality of circular openings, such that the pipette stem of each of the plurality of pipettes is configured to extend into the box-like structure and the pipette bulb is configured to extend outside the box-like structure, wherein each pipette comprises a pipette material which allows light to pass through the pipette material, wherein the diameter of the pipette bulb is wider than the circular opening diameter, such that when each pipette is inserted into one of the plurality of circular openings, the pipette cannot be inserted fully into the box-like structure, and wherein the light source is configured to generate light that is transferred through each of the plurality of pipettes.

2. The apparatus according to claim 1, wherein at least one of the plurality of pipettes is filled with a liquid.

3. The apparatus according to claim 2, wherein the liquid is edible.

4. The apparatus according to claim 1, wherein the pipette stem comprises a pipette opening.

5. The apparatus according to claim 1, wherein the pipette stem is hermetically sealed.

6. The apparatus according to claim 1, further comprising:

a power source arranged inside the box-like structure, wherein the power source is configured to provide power to the light source.

7. The apparatus according to claim 1, further comprising:

a top wall arranged to abut the front wall, the back wall, and the side walls; and a bottom wall arranged to abut the front wall, the back wall, and the side walls, such that the top wall and the bottom wall together with the front wall, the back wall, and the side walls form the box-like structure which is enclosed.

8. The apparatus according to claim 1, wherein the plurality of circular openings are evenly dispersed across the front wall in a grid-like pattern.

9. An apparatus for a liquid light wall module, the apparatus comprising:

an illuminated module, wherein the illuminated module comprises a front wall, a first side wall, a second side wall, a top wall, a bottom wall, and a back wall, the front wall comprising a plurality of a circular openings dispersed across the front wall, wherein the plurality of circular openings perforate the front wall;

a plurality of pipettes, each pipette comprising a pipette bulb and a pipette stem, wherein the plurality of pipettes are made of a transparent material; and a light source, the light source positioned such that light can escape through the plurality of circular openings in the front wall;

wherein the illuminated module is assembled such that the front wall is affixed perpendicular to the first side wall, the second side wall, the bottom wall, and the top wall, and further wherein the illuminated module is assembled such that the first side wall and the second side wall are parallel to one another, and the top wall and the bottom wall are parallel to one another, such that the illuminated module forms a box-like structure, wherein the back wall is positioned parallel to the front wall, further wherein the back wall is affixed perpendicular to the top wall, the bottom wall, the first side wall, and the second side wall, and wherein the pipette bulb has a diameter larger than a diameter of the circular opening, such that when the pipette stem is inserted into one of the plurality of circular openings, the pipette bulb blocks the circular opening, such that the light passes through the pipettes.

10. The apparatus according to claim 9, wherein at least one of the plurality of pipettes is filled with a liquid.

11. The apparatus according to claim 10, wherein the liquid is edible.

12. The apparatus according to claim 9, further comprising:

a non-illuminated module, the non-illuminated module comprising a solid wall, a first side wall, a second side wall, a top wall, a bottom wall, and a back wall;

wherein the non-illuminated module is assembled such that the solid wall is affixed perpendicular to the first side wall, the second side wall, the bottom wall, and the top wall, and further wherein the non-illuminated module is assembled such that the first side wall and the second side wall are parallel to one another, and the top wall and the bottom wall are parallel to one another, such that the non-illuminated module forms a box-like structure, and wherein the back wall is positioned parallel to the solid wall, the back wall affixed perpendicular to the top wall, the bottom wall, the first side wall, and the second side wall, such that the non-illuminated module is enclosed.

13. The apparatus according to claim 9, wherein each of the first side wall, the second side wall, the top wall, and the bottom wall comprises a plurality of access openings, such that an interlocking mechanism installed between the access openings can affix a first illuminated module to a second illuminated module when the access openings of the first side wall of the first illuminated module aligns to the access openings of the second side wall of the second illuminated module.

14. The apparatus according to claim 9, wherein the back wall further comprises:

a fixed backing, the fixed backing affixed perpendicular to the top wall, the bottom wall, the first side wall, and the second side wall, such that the illuminated module is enclosed;

a detachable cover, the detachable cover configured to abut the fixed backing such that the fixed backing and the detachable cover are contiguous;

a backing support, the backing support affixed perpendicular to the side walls and configured to abut the fixed backing; and a cover attachment mechanism, the cover attachment mechanism affixed to the backing support, and configured to temporarily affix the detachable cover to the backing support, such that the detachable cover is removable, and further such that the detachable cover is approximately flush with the fixed backing.

15. The apparatus according to claim 9, wherein the back wall comprises a mounting hole, such that the illuminated module can be affixed to a stable surface.

16. The apparatus according to claim 9, further comprising:

a power source, the power source configured to provide power to the light source.

17. The apparatus according to claim 12, further comprising:

a base assembly, the base assembly further comprising a base attachment mechanism, wherein the base assembly is configured to stabilize the non-illuminated module in a vertical position, and further wherein the base attachment mechanism is configured to affix the base assembly to the non-illuminated module.

18. The apparatus according to claim 9, further comprising a base assembly, the base assembly further comprising a base attachment mechanism, wherein the base assembly is configured to stabilize the illuminated module in a vertical position, and further wherein the base attachment mechanism is configured to affix the base assembly to the illuminated module.

* * * * *